US005114557A

United States Patent [19]

Jahani

[11] Patent Number: 5,114,557

[45] Date of Patent: May 19, 1992

[54] SELECTIVE PLATING APPARATUS WITH OPTICAL ALIGNMENT SENSOR

[75] Inventor: Hooshang Jahani, Fremont, Calif.

[73] Assignee: Tooltek Engineering Corp., Fremont, Calif.

[21] Appl. No.: 659,577

[22] Filed: Feb. 20, 1991

[51] Int. Cl.[5] ..... C25D 17/00

[52] U.S. Cl. ..... 204/206; 204/224 R

[58] Field of Search ..... 204/206, 224 R

[56] References Cited

U.S. PATENT DOCUMENTS

| | | | |
|---|---|---|---|
| 3,723,283 | 3/1973 | Johnson | 204/206 |
| 3,860,499 | 1/1975 | Graham | 204/15 |
| 3,865,698 | 2/1975 | Kosowsky | 204/15 |
| 3,894,918 | 7/1975 | Corby | 204/15 |
| 3,957,614 | 5/1976 | Corby | 204/224 |
| 3,974,056 | 1/1976 | Jogwick | 204/207 |
| 3,977,957 | 8/1976 | Kosowsky | 204/224 R |
| 4,038,169 | 7/1977 | Lovejoy | 204/202 |
| 4,090,928 | 5/1978 | Pantiga | 204/15 |
| 4,367,123 | 1/1983 | Beck | 204/15 |
| 4,378,283 | 3/1983 | Seyffert | 204/206 |
| 4,392,935 | 7/1983 | Husain | 204/206 |
| 4,401,523 | 8/1983 | Avellone | 204/15 |
| 4,409,924 | 10/1983 | Laverty | 118/406 |
| 4,414,075 | 11/1983 | Cockeram | 204/15 |
| 4,505,225 | 3/1985 | Husain | 118/669 |
| 4,553,501 | 11/1985 | Kobayashi | 118/669 |
| 4,921,583 | 5/1990 | Sewell | 204/15 |

FOREIGN PATENT DOCUMENTS

| | | |
|---|---|---|
| 2534934 | 4/1984 | France . |
| 59-028591 | 2/1984 | Japan . |
| 61-008159 | 3/1986 | Japan . |
| 61-043438 | 9/1986 | Japan . |
| 63-016476 | 4/1988 | Japan . |
| 1259192 | 10/1989 | Japan . |
| 708001 | 1/1980 | U.S.S.R. . |
| 1104561 | 7/1984 | U.S.S.R. . |
| 8809223 | 12/1988 | World Int. Prop. O. . |

*Primary Examiner*—T. M. Tufariello

*Attorney, Agent, or Firm*—Fliesler, Dubb, Meyer & Lovejoy

[57] ABSTRACT

Selective plating apparatus for a web includes optical sensor means rigidly attached directly to the plating mask. The optical sensor means is physically isolated from corrosive chemical and vapors in the environment, and cleaning means keeps the ends of the optical fibers free of salt and chemicals and otherwise prevents corrosion.

24 Claims, 3 Drawing Sheets

SELECTIVE PLATING APPARATUS WITH OPTICAL ALIGNMENT SENSOR

BACKGROUND

1. Field of the Invention

The invention relates to apparatus for electroplating selected portions of a web, and more particularly, to registration sensor means for sensing when an intermittently moving web is in registration with a plating mask in a plating head.

2. Description of Related Art

Certain articles of manufacture are provided in a strip web format for electroplating selected portions thereof. For example, lead frames used in the manufacture of integrated circuits are typically stamped from a sheet of conductive metal such a nickel, copper or the like, in the shape of a strip. Each lead frame has a separate group of leads for each chip, and the outer ends of each lead are interconnected to carrier strips which form the two edges of the web. The leads are also interconnected intermediate their ends by relatively narrow support strips. The carrier strips are perforated for feeding them through various treating operations. For completion of the integrated circuit, the inner end of each of the leads is bonded to a respective pad on the chip, and both the carrier and the support strips are severed to separate the individual leads.

In prior art techniques, a layer of precious metal, such as gold, has often been formed by electroplating one surface of the leads in order to improve bondability with the wires that connect them to the integrated circuit chips. Further, in order to minimize the amount of precious metal used, the precious metal has been plated selectively only at the portions of the leads nearest the chips.

One way of plating only the selected portions of a strip of metal, is to guide the strip through a plating head along a path of travel. The strip is intermittently advanced a certain distance, and when it stops, the plating head clamps the strip so that plating electrolyte may be washed against the surface of the strip from apertures in a plating mask in the plating head. The mask apertures are of precise size, shape and location relative to each other so that electrolyte is channeled only to the portions of the strip that are desired. However, if the strip is to be plated in the exact right spot, it is necessary that the strip always be positioned correctly relative to the mask when the strip comes to rest. To accomplish this, a mechanism is used to ascertain the longitudinal position of the strip relative to the plating head along the path of travel, and additional mechanisms move either the strip or the head so as to achieve the correct position.

In Laverty U.S. Pat. No. 4,409,924, hereby incorporated by reference, a plating apparatus is described which uses mechanical means for ensuring proper registration. In Laverty, a moveable pawl is mounted on the plating mask and is moved into engagement with indexing holes in the metal strip just as the strip is completing its movement. This causes the entire mask to float with the strip during the last small increment of strip movement and come to rest in the correct alignment with the strip. The mask is constructed as a separate lightweight structure that can slide a short distance relative to the overall plating head.

However, mechanical registration means which employ a pawl or pin to find a hole in the web, such as the pawl technique described in Laverty, are disadvantageous because the pawl or pin can scratch the metal of the web as the web moves over it. The pin can also bend the metal of the web undesirably. Further, such mechanisms can be costly and require service for moving parts.

In Corby U.S. Pat. No. 3,957,614, hereby incorporated by reference, a selective plating apparatus for lead frames is disclosed which includes an electro-optical sensing device 82. The sensing device includes a light source and a photocell facing each other from opposite sides of the web, and disposed along the path of travel such that certain apertures, spaced at predefined positions along a carrier strip of the web, periodically expose the photocell to light emitted by the light source as the web moves. The electro-optic sensor is mounted separately from the plating head as shown in Corby's FIG. 2, possibly to avoid corrosion by the caustic chemicals used in the plating process. Corrosion is less of a problem in the mechanical sensing devices, since the pawl or pins used therein may be made of corrosion resistant materials.

The sensing means disclosed by Corby does not risk scratching or bending the metal of the web, but instead has other disadvantages. In particular, since the sensor is mounted separately from the plating head, there is no rigid connection between them. Flexing of various of the supports can cause relative movement longitudinally along the path of travel of the web between the sensor and the particular locations of the web which will be plated by the plating head. Any such relative movement will cause an inaccuracy in the positions on the metal web which become plated. Nor does Corby in any way protect the sensor from caustic chemicals.

Other patents which disclose various registration means for a selective plating head include Husain U.S. Pat. No. 4,392,935; Johnson U.S. Pat. No. 3,723,283; Husain U.S. Pat. No. 4,505,225; Graham U.S. Pat. No. 3,860,499; Jogwick U.S. Pat. No. 3,974,056; and Japanese Patent Publication No. 55079894, all of which are incorporated by reference herein.

Accordingly, there is a need in the selective plating industry for a method of sensing the longitudinal position of a subject web, accurately and without risk of damaging the web.

SUMMARY OF THE INVENTION

According to the invention, roughly stated, selective plating apparatus includes a plating head having a plating mask with a plurality of apertures therein at predefined locations relative to each other to define the portions of the web which are to be selectively plated, and an optical sensor means rigidly attached directly to the plating mask. The use of an optical sensor instead of a mechanical sensor enables quicker and more accurate response, and avoids damaging the web material, and the rigid attachment of the optical sensor to the plating mask prevents any relative movement between the sensor and the apertures defining the plating regions of the web. In order to avoid corrosion, the optical sensor means is itself housed inside an enclosure which isolates it from the corrosive chemicals and vapors used in the process. Any openings may be subject to positive pressure to prevent these materials from entering. Only a pair of optical fibers, optically coupled respectively to a light source and a detector in the optical sensor means, extend from the enclosure. The free ends of these optical fibers are positioned adjacent to the path of travel of the web and oriented so that light emitted from the end of one fiber and reflected off the reflective surface of a metallic web will enter the end of the other fiber and be coupled to the detector. Cleaning means is provided to keep the ends of the optical fibers free of salt and chemicals and to otherwise prevent corrosion.

BRIEF DESCRIPTION OF THE DRAWINGS

The invention will be described with respect to particular embodiments thereof, and reference will be made to the drawings, in which.

DETAILED DESCRIPTION

Although the invention is useable with many types of webs to be selectively plated, the invention will be described particularly with reference to the selective plating of a strip web made up of metal lead frames. Other types of webs in which the invention may be used include those containing pins for electrical connectors, as well as webs on which selective plating is to occur on both sides.

Figure 1:
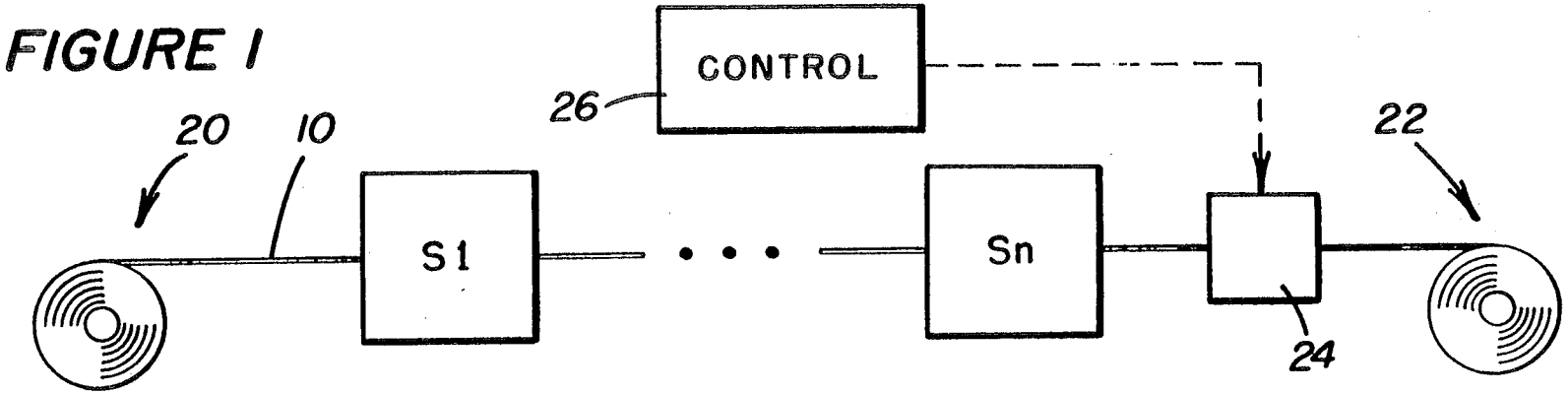
FIG. 1 shows a system in which plating apparatus according to the invention may be used.

Johnson U.S. Pat. No. 3,723,283, incorporated herein by reference, describes prominent features of a typical selective plating system. As shown in FIG. 1, such a system can include a plurality of stations S1–Sn to perform various operations on a web 10 as it moves along its path of travel from a discharge reel 20 to a takeup reel 22. Such operations may include acid etching, alkaline electro cleaning, drying, and selective plating. Takeup reel 22 is preceded by a conventional indexing system 24, which advances the web 10 intermittently by a predetermined distance between each pause. A sensing means (not shown in FIG. 1) senses the longitudinal position of the web 10 along its path of travel, providing signals to a control unit 26. The control unit 26 provides signals to indexing system 24 to cause it to advance the web 10 just enough so that it moves into precise registration with the selective plating station. The indexing system 24 may, for example, advance the web 10 by most of the necessary distance each time at a high rate of speed, and then slow to a very slow speed until the sensing means indicates registration.

Figure 2:
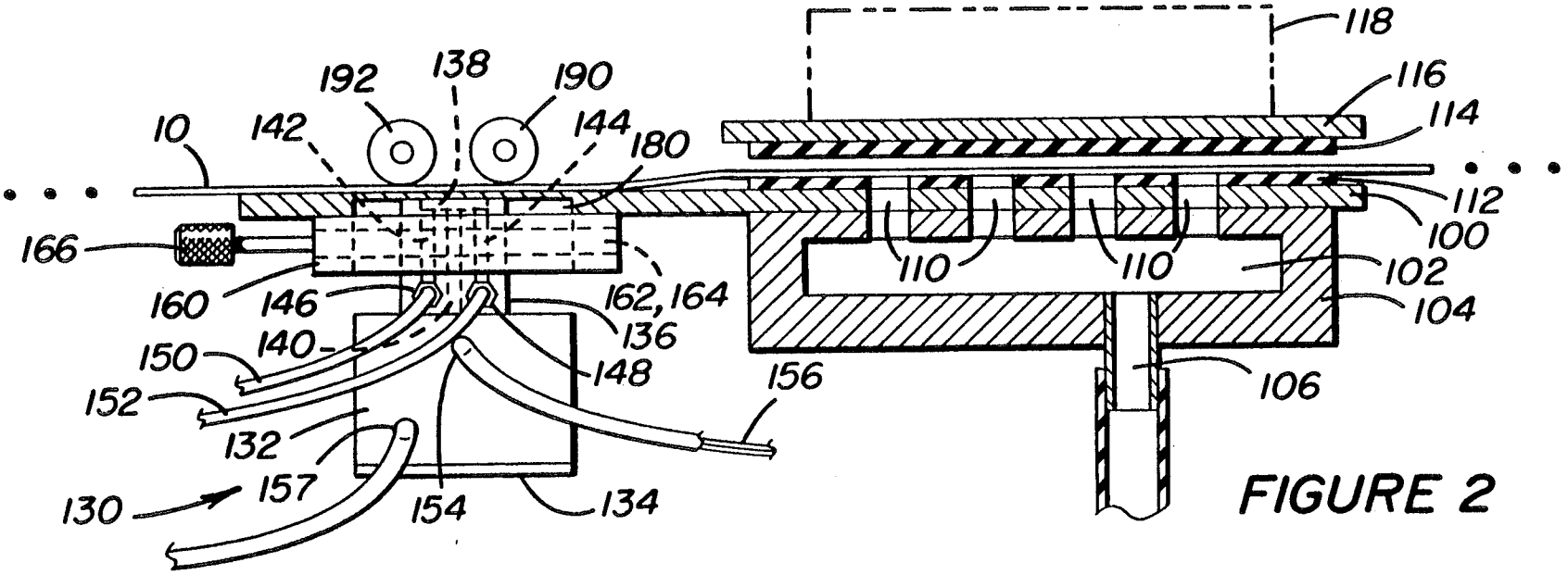
FIG. 2 is a side view of plating apparatus according to the invention.

FIG. 2 shows a side view of a selective plating station according to the invention, which is one of the stations S1–Sn of FIG. 1. It comprises a plating mask 100 which is removably attached to the top of an electrolyte chamber 102 formed by an enclosure 104. The electrolyte chamber 102 has an electrolyte solution inlet 106, which is coupled to an electrolyte supply (not shown). As described in more detail below, the plating mask 100 includes a plurality of apertures 110 which define the specific locations, relative to each other, which are to receive the electrolyte plating solution from the chamber 102. A compliant elastomeric sealing layer 112, which is attached to the top of the plating mask 100, also includes apertures corresponding to the apertures 110 in the plating mask 100.

Above the sealing layer 112 and spaced therefrom is another compliant elastomeric sealing pad 114 attached to a rigid support plate 116. The sealing pad 114 and support plate 116 are of a size and shape which corresponds to that of the sealing layer 112. Though the sealing pad 114 and support plate 116 are both solid in the apparatus of FIG. 2, it will be understood that these members, too, can be provided with apertures of their own for 2-sided plating of the web.

In operation, indexing system 24 (FIG. 1) pulls the web 10 along its path of travel between the two sealing layers 112 and 114. After registration is indicated, a closing means 18, shown symbolically in FIG. 2, presses the support plate 116 down against the web 10 to enable the sealing pads 112 and 114 to make a tight seal around the apertures 110. Electrolyte solution then flows through the chamber 102 and the apertures 110, and appropriate electrical potentials are applied by means not shown. Electroplating of the selected areas on the web, defined by the apertures 110, is thereby accomplished by conventional means. When the plating operation is complete, closing means 118 lifts the support plate 116 and indexing system 24 pulls the web 10 along the path of travel until the next portion of the web to be plated is in appropriate registration with the apertures 110. Though only four apertures 110 are shown in FIG. 2, it will be understood that the number can vary as desired. If it is lead frames being plated, for example, the plating mask 100 may include 19 different apertures 110 for plating 19 different lead frames arranged in a strip on the web 10 at once.

Conventionally, the plating mask 100 (with its attached sealing pad 112) can be removed and a new plating mask attached in its place. If the new plating mask has different apertures than the one just removed, then it can be used in the same equipment to plate webs which require a different set of relative plating positions. For example, different size lead frames may be plated using a replacement mask with different size apertures, or a web containing connector pins can be plated if the apertures are shaped differently and spaced differently from each other.

Figure 3:
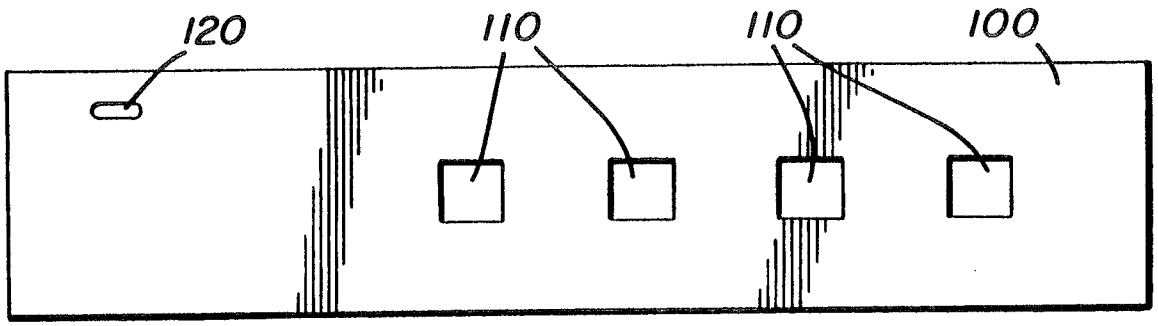
FIG. 3 is a top view of a plating mask according to the invention.

FIG. 3 shows a top view of the plating mask 100. It can be seen that the four apertures 110 are square, and slightly larger than the chips which are to be bonded to each of the four lead frames. Thus, only a small portion the inner ends of each of four lead frames in a row will be plated by the selective plating station of FIG. 2. The plating mask 100 further includes an elongated hole 120, along the path of travel of the web 10, and adapted to expose a portion of the edge of the web as it passes the hole. The hole 120 is positioned out of the way of the sealing pads 112 and 114. The hole 120 is elongated longitudinally along the path of travel. As explained in more detail below, the hole 120 is used to expose a portion of the edge of the web to an optical sensor means.

Attached directly to the underside of the plating mask is an optical sensor means 130. The optical sensor means 130 can be used either upstream or downstream of the plating head. Since the web is typically dry prior to the plating operation, the optical sensor means 130 is preferably located on the upstream side of the apertures 110 in order to minimize contact with plating solutions. However, the optical sensor means 130 can instead be located downstream of the apertures 110 if desired for use with existing plating mask tooling.

The optical sensor means 130 is described in more detail below, but generally it comprises a thermally stable non-metallic enclosure 132 for housing certain electronic circuitry. The enclosure 132 is covered by a removable bottom plate 134. The enclosure 132 also includes an optical portion 136 having a small well 138 in the top thereof. A bore 140 connects the well 138 with the interior of the enclosure 132, for passage of a pair of optical fibers (not shown in FIG. 2). The optical portion 136 also includes two additional bores 142 and 144 coupling the well 138 with respective fittings 146 and 148 on the optical portion 136. The fittings 146 and 148 are coupled to respective air and water supplies (not shown in FIG. 2) via respective hoses 150 and 152. The purpose for the air and water supplies will become apparent below. The enclosure 132 has an additional hole 154 for passing a set of wires 156 from the circuitry inside the enclosure 132 to the control unit 26 (FIG. 1), and another hole 157 for supplying a neutral purging gas into the enclosure.

Figure 4:
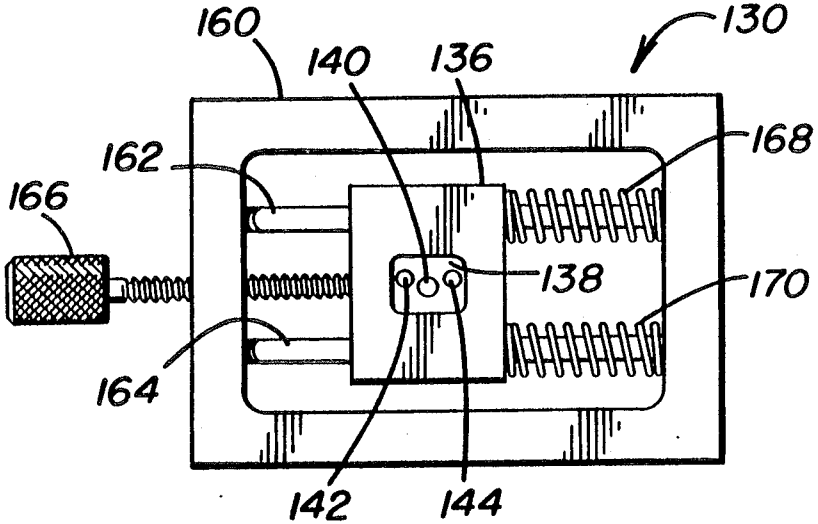
FIG. 4 is a top view of the optical sensor means 130 shown in FIG. 2.

The enclosure 132 with its optical portion 136 is affixed to the underside of the plating mask 100 by a bracket 160, a top view of which is shown in FIG. 4. It is shaped as a rectangular frame with two guide rods 162 and 164 extending across it longitudinally in the direction of the path of travel of the web 10. The guide rods 162 and 164 guide the enclosure 132, allowing any fine adjustment of the position of the enclosure 132 along the longitudinal dimension. An adjustment screw 166 passes through a screw hole on one side of the frame and comes in contact with the optical portion 136 of the enclosure 132 to oppose the force of two springs 168 and 170 on the respective guide rods 162 and 164. Thus, by turning screw 166, an operator can finely adjust the longitudinal position of the optical sensor location With respect to the apertures 110 in the plating mask 100. The device keeps the location mechanically stable after adjustment so as not to move during the operation of the plating system.

As shown in FIG. 2, the optical portion 136 of the enclosure 132 extends slightly above the mounting frame 160 into a cavity 180 in the underside of the plating mask 100. The elongated hole 120, described above with respect to FIG. 3, is positioned directly above at least the center bore 140 in the optical portion 136. A portion of the edge of the web 10 is thereby exposed to the optical fibers protruding through the bore 140 from the circuitry in the enclosure 132. The hole 120 is elongated in the longitudinal dimension of the path of travel of the web 10 both to maintain the exposure as the longitudinal position of the optical sensor is adjusted longitudinally by the adjustment screw 166, and also to permit access to the tips of the optical fibers by the air and water jets described in more detail below.

Also mounted on the top of the plating mask 100 are a pair of rollers 190 and 192 by means not shown. The roller 190 is positioned just downstream of the hole 120 in the plating mask 100, and the roller 192 is positioned just upstream of the hole 120. The rollers keep the web 10 against the web-facing surface of the plating mask 100 as it passes over the hole 120 to keep the reflective surface of the web 10 at a constant distance from the tips of the optical fibers emerging from bore 140.

Figure 5:
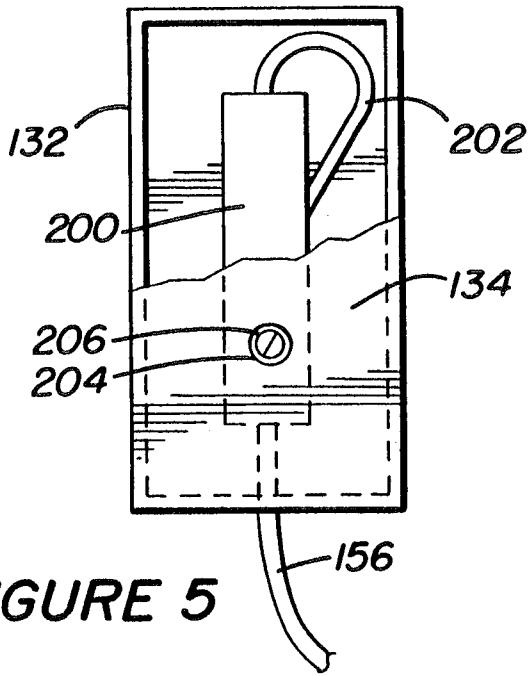
FIG. 5 is a bottom view of a portion of the optical sensor means 130 of FIG. 2, partially cut away.

FIG. 5 is a bottom view of the enclosure 132 with the bottom cover partially cut away. The electronic circuitry 200 inside the enclosure 132 has one port coupled to the electrical wires 156, previously described, and another port having a pair of optical fibers emanating therefrom within a single tube 202. The optical fibers go through the bore 140 (situated behind the circuitry 200 in FIG. 5) in the optical portion 136. The circuitry 200, which is conventional, emits light via one of the optical fibers and senses light returned via the other. As explained in more detail below, this permits sensing of the longitudinal position of the reflective metallic patterns on the web. When a reflective portion of the web is positioned directly over the bore 140, light emitted by one of the optical fibers reflects off the metal and returns to the circuitry 200 via the other optical fiber. The circuitry 200 then generates appropriate signals on the electrical conductors 156 for the control unit 26 (FIG. 1) by conventional means.

Figure 6A:
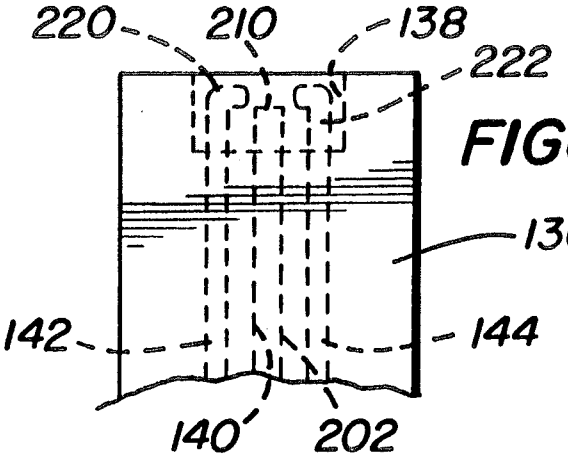
FIGS. 6A and 6B are enlarged side and top views, respectively, of the optical portion 138 of the enclosure 132 of FIG. 2.
Figure 6B:
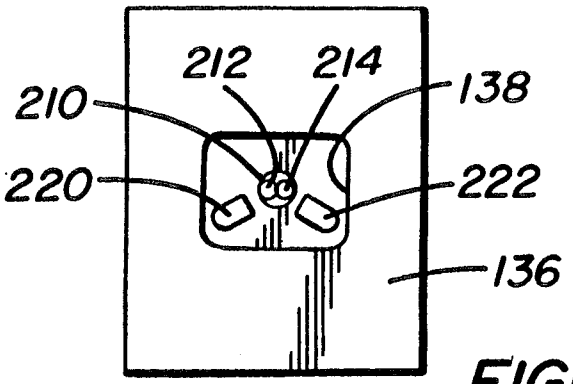

FIGS. 6A and 6B are greatly enlarged side and top views, respectively, of the optical portion 136 of the enclosure 132, showing the optical fibers and the tubes for the air and water jets. The tube 202 containing the two optical fibers projects from the bore 140 through a stainless steel sleeve 210 to a point in the well 138 just below the hole 120 in the plating mask 100 (FIG. 3). As can be seen in FIG. 6B, both optical fibers 212 and 214 terminate at about the same height, and their distal end surfaces together form an optical sensor surface.

A small bent tube 220 is press fitted into the bore 142 and aimed to direct an air jet from bore 142 across the optical sensor surface. A similar bent tube 222 in the well 138 is press fitted into the bore 144 and oriented to direct a jet of water across the optical sensor surface. The two bores 142 and 144 are not in line with the bore 140, so that the water jet being emitted from the tube 222 will not be directed toward the outlet of tube 220, and vice versa.

Figure 7:
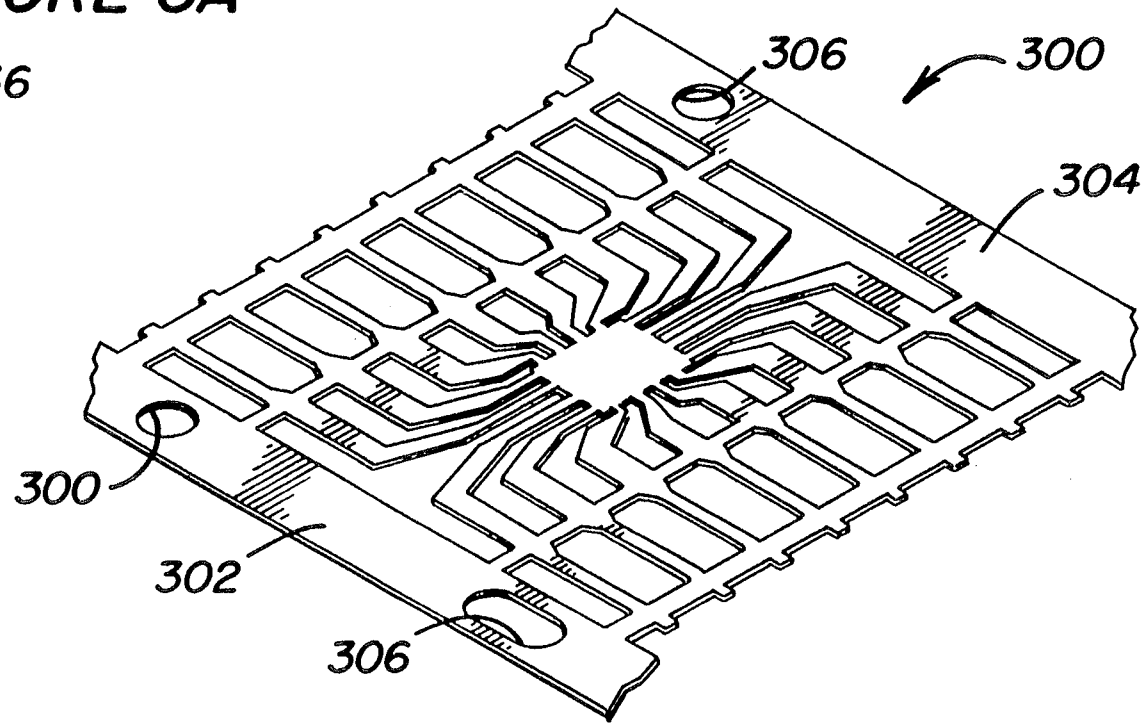
FIG. 7 shows a portion of a web with which the invention may be used.

The operation of the selective plating station of FIG. 2 will be described for a web made up of a strip of lead frames such as the lead frame 300 shown in FIG. 7. As can be seen, the lead frame is made up of a pattern of conductive metal having two edge portions 302 and 304 on opposite edges of the frame 300. The edge portions 302 and 304 run the length of the web, and help to hold the lead frames together as a strip during processing. The edge portions 302 and 304 also include a plurality of holes 306 of predefined size and position relative to the lead frames, which can be used for indexing purposes.

Before the web is fed through the selective plating station, the exact location of the optical sensor apparatus 130 relative to the apertures 110 in the plating mask 100 is finely adjusted by appropriately rotating adjustment screw 166 in the mounting bracket 160. Then, before a given set of lead frames is ready for plating, the control means 26 (FIG. 1) causes the indexing system 24 to advance the web 10 at a relatively high velocity for a predetermined approximate period of time. This brings the lead frames within a few tenths of an inch of alignment with the apertures 110 in the plating head 100. The control means 26 then causes the indexing system 24 to advance the web 10 very slowly, while observing the signals provided from the electrical circuitry 200 (FIG. 5) over the wires 156. The circuitry 200, as previously explained, emits light via one optical fiber 212, the distal end of which is aimed substantially perpendicularly toward one of the edge portions 304 of the lead frames. Due to the reflective nature of the metallic edge portion 304, at least part of the light emitted by the optical fiber 212 is reflected back into the distal end of optical fiber 214 and returned to the circuitry 200. The circuitry 200 then provides signals on wires 156 indicating that the web 10 is not yet in registration. As the web 10 continues to move longitudinally along its path of travel, the indexing hole 306 will at some point begin to pass over the tips of the optical fibers 212 and 214. At that time, there is no longer any reflective material to reflect the light emitted by optical fiber 212 back into optical fiber 214. The circuitry 200 senses this, and changes the signals on the wires 156 to indicate that the web 10 is now in registration with the apertures 110 in the plating mask 100. The control means 26 then causes the indexing system 24 to stop advancing the web 10, and the closing means 118 closes the plating head. The sealing pads 112 and 114 form a tight seal around the apertures 110, preventing the flow of any electrolyte onto the lead frames outside the specific areas defined by the apertures 110. Electrolyte fluid flows into the chamber 102, appropriate currents and voltages are applied, and the plating takes place in a conventional manner. When the plating operation for this set of lead frames is complete, the closing means 118 opens, and the control means 26 causes the indexing system 24 to advance the web 10 at the relatively high rate of speed to within a few tenths of an inch of the position where the next set of lead frames will be in registration. This process repeats until all the lead frames on the reel 20 have been selectively plated.

Since the alignment sensor used in the apparatus of FIG. 2 is optical rather than mechanical, it does not risk damaging the thin metal of the lead frames 300 of the strip by scratching or bending it. Nor is service required for moving parts. Additionally, since the optical sensor means is affixed directly to the plating mask 100, instead of to a separate support, the positioning of each set of lead frames relative to the apertures 110 is very accurate. Caustic chemicals and vapors are involved in the plating process, however, and since the optical sensor means is so close to the plating apparatus, the apparatus of FIG. 2 includes several features for protecting the optics and electronics from corrosion and salt build-up.

First, the circuitry 200 is entirely enclosed in the enclosure 132. Only hole 204 is open, and it is subject to positive pressure from the purging gas supplied to the enclosure through hole 157.

Second, the tube 220 continuously emits a jet of air across the optical sensing surface formed by the tips of optical fibers 212 and 214 (FIGS. 6A and 6B). This minimizes any salt build-up on the surface.

Third, a jet of water is emitted by the tube 222 over the optical sensing surface during the time period when the web is stationary and actual plating is taking place. During this time, the control means 26 ignores the signals on wires 156, so any optical distortion caused by the water flowing over the optical sensor surface will be ignored. The water jet can be cycled every n'th cycle of the plating operation, or it can cycle every time plating is taking place.

Another cleaning method which could be used to protect the optical sensor means 130, not shown in the figures, is a small wiper which brushes over the optical sensor surface once or twice each time the web comes to a full stop.

The apparatus of FIG. 2 is subject to many variations. For example, an embodiment may be designed which indicates registration not when the foremost edge of the hole 306 begins to cross over the optical sensing surface, but rather when the hole 306 has entirely crossed the optical surface and the trailing edge of the hole begins to pass over the optical sensing surface. Alternatively, the control means 26 can be programmed to wait for both the leading and trailing edges of the hole 306 to pass over the optical sensing surface before indicating registration. In another variation, the invention can be used with patterned metal webs which do not have holes 306 in edge portions 304 available specifically for indexing purposes. In such a case the optical sensing surface can be located under part of the pattern itself, and the control means 26 can be programmed to wait for a predetermined pattern of signals on the wire 156 corresponding to the pattern of reflective material in the web. Indeed, it is an advantage of the present optical sensing technique that the web need not have any cutouts provided specifically for alignment sensing. Additionally, since the optical sensor merely detects changes in the light level entering the optical sensing surface, the technique will also work on non-metallic webs which do not have any holes or cutouts, as long as paint or other markings are provided which change the light level reflected back into the optical sensing surface as the web moves along its path of travel.

In another variation, the emitting and receiving optical fibers can be directed toward each other from above and below the web, so that light emitted by one enters the other directly rather than by reflection. In this arrangement, light would be received at the distal end surface of the receiving optical fiber only when a hole, such as hole 306 (FIG. 7), is passing between the two fibers.

The invention has been described with respect to particular embodiments thereof, and it will be understood that numerous variations are possible within its scope in addition to those mentioned above.

I claim:

1. Apparatus for plating selected portions of a web being moved intermittently along a path of travel, comprising:

a plating mask disposed along said path and having a web facing side, said plating mask having a plurality of apertures through said web facing side at predefined locations relative to each other to define said selected portions of said web relative to each other;

means for sealing said web against said web facing side of said plating mask and for supplying a plating fluid through said apertures to said web during pauses in the movement of said web; and optical sensor means having an optical sensor surface disposed along said path of travel to detect registration of said web relative to said apertures, said optical sensor surface being rigidly attached to said plating mask.

2. Apparatus according to claim 1, further comprising cleaning means for cleaning said optical sensor surface.

3. Apparatus according to claim 2, wherein said cleaning means comprises means for forcing air across said optical sensor surface

4. Apparatus according to claim 2, wherein said cleaning means comprises means for forcing a cleaning liquid across said optical sensor surface during pauses in the movement of said web.

5. Apparatus according to claim 4, wherein said means for forcing a cleaning liquid does so only on every n'th pause in the movement of said web, $n>1$.

6. Apparatus according to claim 2, wherein said cleaning means comprises:

means for forcing air across said optical sensor surface continuously; and means for forcing a cleaning liquid across said optical sensor surface during each n'th pause in the movement of said web, $n>1$.

7. Apparatus according to claim 1, wherein said optical sensor means comprises:

a light source and a detector;

a first optical fiber optically coupled to receive light from said light source and having a distal end surface directed toward said web; and a second optical fiber optically coupled to transmit light to said detector and having a distal end surface directed toward said web and oriented to receive light transmitted by said first optical fiber, said optical sensor surface comprising said distal end surface of said second optical fiber.

8. Apparatus according to claim 7, wherein said web includes reflective portions at predetermined longitudinal positions relative to said selected portions, and wherein said distal end surface of said second optical fiber is oriented to receive light from said first optical fiber which is reflected off said reflective portions of said web, said optical sensor surface further comprising said distal end surface of said first optical fiber.

9. Apparatus according to claim 8, further comprising means for maintaining said web at a constant distance from said optical sensor surface at the longitudinal position along said path of travel where said web passes said optical sensor surface.

10. Apparatus according to claim 1, further comprising isolation means for physically isolating said optical sensor means from the surrounding environment.

11. Apparatus according to claim 10, wherein said isolation means comprises an enclosure enclosing said optical sensor means and means for supplying a purging gas into said enclosure to create a positive pressure therein.

12. Apparatus according to claim 1, further comprising adjustable means for adjusting the longitudinal position of said optical sensor surface relative to said apertures and for maintaining said longitudinal position when not being adjusted.

13. Apparatus for plating selected portions of a web being moved intermittently along a path of travel, comprising:

a plating mask disposed along said path and having a web facing side, said plating mask having a plurality of apertures through said web facing side at predefined locations relative to each other to define said selected portions of said web relative to each other;

means for sealing said web against said web facing side of said plating mask and for supplying a plating fluid through said apertures to said web during pauses in the movement of said web;

optical sensor means having an optical sensor surface disposed along said path of travel to detect registration of said web relative to said apertures; and cleaning means for cleaning said optical sensor surface.

14. Apparatus according to claim 13, wherein said cleaning means comprises means for forcing air across said optical sensor surface.

15. Apparatus according to claim 13, wherein said cleaning means comprises means for forcing a cleaning liquid across said optical sensor surface during pauses in the movement of said web.

16. Apparatus according to claim 15, wherein said means for forcing a cleaning liquid does so only on every n'th pause in the movement of said web, $n>1$.

17. Apparatus according to claim 13, wherein said cleaning means comprises:

means for forcing air across said optical sensor surface continuously; and means for forcing a cleaning liquid across said optical sensor surface during each n'th pause in the movement of said web, $n>1$.

18. Apparatus according to claim 13, wherein said optical sensor means comprises:

a light source and a detector;

a first optical fiber optically coupled to receive light from said light source and having a distal end surface directed toward said web; and a second optical fiber optically coupled to transmit light to said detector and having a distal end surface directed toward said web and oriented to receive light transmitted by said first optical fiber, said optical sensor surface comprising said distal end surface of said second optical fiber.

19. Apparatus according to claim 18, wherein said web includes reflective portions at predetermined longitudinal positions relative to said selected portions, and wherein said distal end surface of said second optical fiber is oriented to receive light from said first optical fiber which is reflected off said reflective portions of said web, said optical sensor surface further comprising said distal end surface of said first optical fiber.

20. Apparatus according to claim 13, further comprising isolation means for physically isolating said optical sensor means from the surrounding environment.

21. Apparatus according to claim 20, wherein said isolation means comprises an enclosure enclosing said optical sensor means and means for supplying a purging gas into said enclosure to create a positive pressure therein.

22. Apparatus for plating selected portions of a web being moved intermittently along a path of travel, comprising:

a plating mask disposed along said path and having a web facing side, said plating mask having a plurality of apertures through said web facing side at predefined locations relative to each other to define said selected portions of said web relative to each other;

means for sealing said web against said web facing side of said plating mask and for supplying a plating fluid through said apertures to said web during pauses in the movement of said web; optical sensor means having an optical sensor surface disposed along said path of travel to detect registration of said web relative to said apertures, said optical sensor surface being rigidly attached to said plating mask;

isolation means for physically isolating said optical sensor means from the surrounding environment;

means for forcing air across said optical sensor surface continuously; and means for forcing a cleaning liquid across said optical sensor surface during each n'th pause in the movement of said web.

23. Apparatus according to claim 22, further comprising first and second rollers disposed along said path of travel respectively upstream and downstream of said optical sensor surface, disposed and oriented to press said web against said web-facing side of said plating mask.

24. Apparatus according to claim 22, further comprising adjustable means for adjusting the longitudinal position of said optical sensor surface relative to said apertures and for maintaining said longitudinal position when not being adjusted.

* * * * *